United States Patent [19]

Lane

[11] 4,177,918

[45] Dec. 11, 1979

[54] CARTON

[75] Inventor: Robert W. Lane, Park Hills, Ky.

[73] Assignee: The C. W. Zumbiel Company, Cincinnati, Ohio

[21] Appl. No.: 939,327

[22] Filed: Sep. 5, 1978

[51] Int. Cl.[2] ..... B65D 5/10; B65D 5/06; B65D 5/28

[52] U.S. Cl. ..... 229/39 B

[58] Field of Search ..... 229/38, 39 B

[56] References Cited

U.S. PATENT DOCUMENTS

| | | | |
|---|---|---|---|
| 2,714,981 | 8/1955 | Leavens | 229/38 |
| 2,732,123 | 1/1956 | Bolding | 229/39 B UX |
| 2,732,996 | 1/1956 | Pantalone | 229/39 B |
| 2,841,320 | 1/1958 | Currivan | 229/39 B |
| 3,047,203 | 7/1962 | Etlinger | 229/39 B |
| 3,059,830 | 10/1962 | Kramer | 229/39 B |
| 3,115,290 | 12/1963 | Byassee | 229/39 B |
| 3,194,475 | 7/1965 | Ralston | 229/38 |
| 3,400,879 | 9/1968 | O'Brien et al. | 229/39 B |
| 3,693,866 | 9/1972 | Struble | 229/39 B |

*Primary Examiner*—Davis T. Moorhead
*Attorney, Agent, or Firm*—Wood, Herron & Evans

[57] ABSTRACT

An improved carton having, in preferred form, a break-away partition fixed between opposed side walls of the carton when the carton is initially erected into a use position from a collapsed position. The break-away partition comprises a transverse stop-rib fixed to opposite side walls at the closed end of the carton, and a cushion flap hingedly connected to one side wall only and connected in break-away fashion to the stop-rib. When an article is inserted into the open end of the erected but unfilled carton, the insertion step causes the cushion flap to break-away from the stop-rib at the carton's closed end. This allows the support rib to function as a seat for one end of the article, and this also deforms the cushion flap only as required so as to enhance the cushioning characteristic of that flap for the sides of the article, when the article is fully located in the carton.

12 Claims, 6 Drawing Figures

CARTON

This invention relates to cartons. More particularly, this invention relates to an improved carton especially adapted to enclose fragile articles such as, e.g., electronic tubes, elongated light bulbs, and the like.

Special carton structures have long been known for protecting fragile articles such as electronic tubes, elongated light bulbs, and the like. In providing protection, prior art cartons make use of a packing structure interiorly of the carton to protect the fragile article packed within the carton. Initially, such cartons include a packing element in the form of a tubular corrugated board insert adapted to encircle the fragile article within the carton. In this structural combination, the tubular corrugated board packing element is spearate from the carton structure itself. Subsequently, a carton for fragile articles was developed that included an integral packng element which is part of the carton blank as initially cut. This packing element is in the nature of a hinged wall located interiorly of the carton once the carton blank is glued and erected into carton configuration. A fragile article carton with this hinged position wall structure is illustrated in Currivan U.S. Pat. No. 2,611,529. More recently, there has been used in the marketplace a one-piece carton structure having an interior sleeve (as opposed to an interior wall ) that fully encircles the fragile article within the carton. This interior sleeve is, in a sense, a carton within a carton, and is retained in spaced relation from the carton by structure associated with that interior sleeve. A fragile article carton structure of this latter type is illustrated in Kramer U.S. Pat. No. 3,059,830.

One problem associated with the interior wall carton structure is that the floating interior wall, by itself, does not provide sufficient cushioning for the fragile article packaged in the carton under commercial use conditions under all circumstances. One problem associated with the interior sleeve carton structure is that the carton requires a significant and substantial amount of paper board which, in commercial practice, may increase the cost of the carton to an undesirable level. Both of these prior art cartons, however, are readily adapted for use with automatic carton erecting and article packaging equipment, i.e., by conventional automatic cartoning machinery.

It is the objective of this invention to provide an improved carton particularly adapted for use with elongated fragile articles which adequately protects the fragile articles within the erected carton, yet which minimizes the paper board required for the carton structure, the improved carton being commercially erectable and loadable by conventional automatic cartoning machinery.

In accord with this objective, the improved carton of this invention comprises, in preferred form, a break-away partition fixed between opposed side walls of the carton when the carton is initially erected into a use position from a collapsed position. The break-away partition comprises a transverse stop-rib fixed to opposite side walls at the closed end of the carton, and a cushion flap hingedly connected to one side wall only and connected in break-away fashion to the stop-rib. When an article is inserted into the open end of the erected but unfilled carton, the insertion step causes the cushion flap to break-away from the stop-rib at the carton's closed end. This allows the support rib to function as a seat for one end of the article, and this also deforms the cushion flap only as required so as to enhance the cushioning characteristic of that flap for the sides of the article, when the article is fully located in the carton. Other objectives and advantages of this invention will be more apparent from the following detailed description taken in conjunction with the drawings in which:

Figure 1:
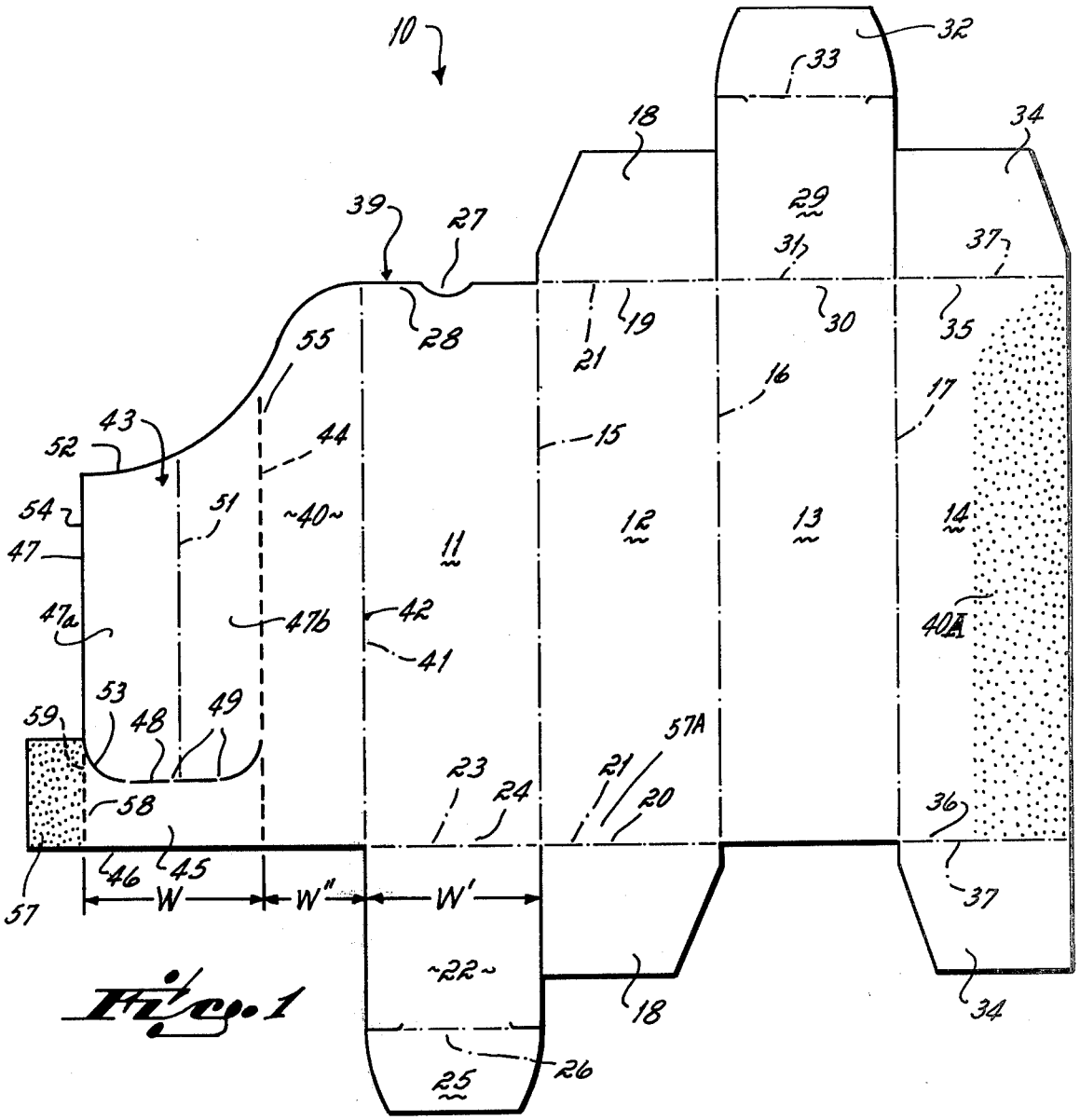
FIG. 1 is a top plan view of a carton blank in accord with the principles of this invention.
Figure 4:
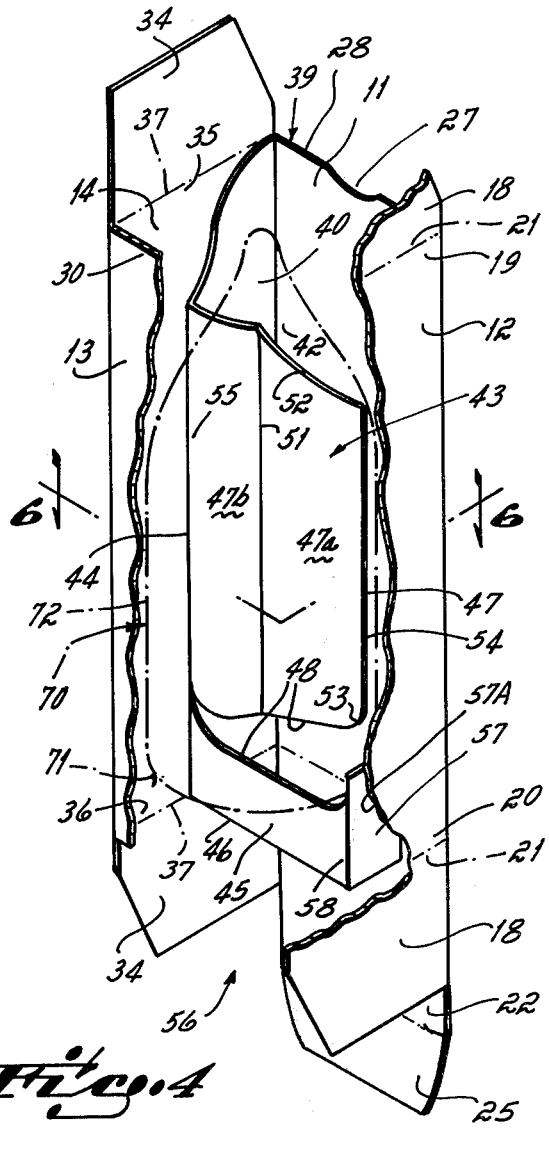
FIG. 4 is a perspective view partly in section, similar to FIG. 3, the carton being illustrated after seating of a fragile article in the carton.
Figure 6:
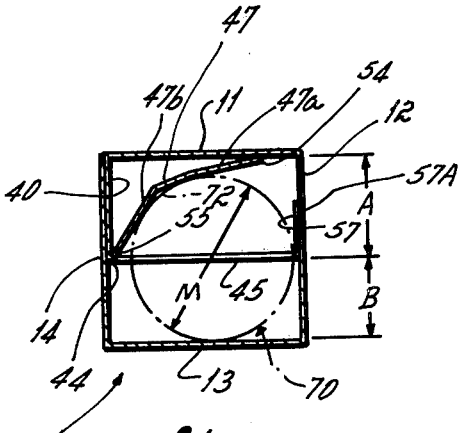

FIG. 6 is a cross sectional view of FIG. 4. An improved carton in accord with the principles of this invention is illustrated in FIG. 1 in blank 10 form, and in partially glued form in FIG. 2. As shown in FIG. 1, the improved carton blank 10 includes four extended length side wall panels 11–14 disposed in side-by-side relation, successive side wall panels being separately defined one from the other by regular score lines 15–17 without perforations or cuts or nicks. The first side wall panel 11 has a base end wall panel 22 connected by a regular score line 23 along the bottom edge 24 thereof, that end wall panel carrying a tuck flap 25 connected by a regular score line 26 at its free edge. The first side wall panel 11 also includes a thumb notch 27 cut out along the top edge 18 thereof. The second side wall panel 12 includes end tabs 18 at the top edge 19 and bottom edge 20 thereof, these end tabs being connected by regular score lines 21 to the second side wall panel. The third side wall panel 13 includes a top end wall panel 29 connected along the top edge 30 thereof by a regular score line 31, that end wall panel being connected with a tuck flap 32 at the free edge thereof along regular score line 33. The fourth side wall panel 14 includes end tabs 34 extending from the top 35 and bottom 36 edges thereof, the end tabs being connected by regular score lines 37 to the fourth side wall panel.

Figure 5:
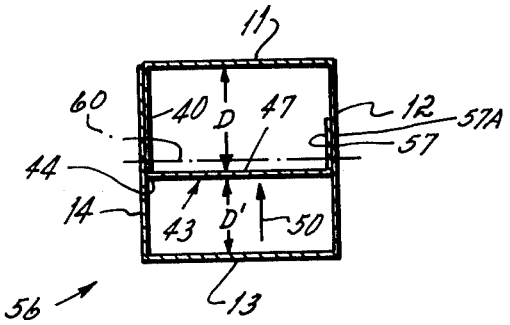
FIG. 5 is a cross sectional view of FIG. 3.

The carton blank 10 also includes a break-away partition panel 43, as shown particularly in FIG. 1. The break-away partition panel 43 is connected with a glue flap 40 by means of a perforated score line 44 parallel to the side edge 42 of that first side wall panel 11. The glue flap 40 is connected by a regular score line 41 along side edge 42 of the first side wall panel 11. The break-away partition panel 43 is comprised of a stop-rib 45 adjacent the bottom edge 46 of the blank 10, and a cushion flap 47 that extends upwardly from the stop rib toward the top edge 39 of the carton blank. the width W of the stop rib is essentially equal to the width W′ of its adjacent side wall panel 11. The width W″ of the glue flap is sized, relative to the width W′ of the adjacent side wall panel 11, so as to position the break-away partition panel 43 in the desired location when the carton blank 10 is glued and fully erected as is illustrated in FIG. 5 and as is more particularly described in detail below.

The break-away partition panel 43, as mentioned, includes a cushion flap 47 hingedly connected by the perforated score line 44 to glue flap 40. This cushion flap 47 is connected by a cut line 48 with the stop rib 45, but the cut line 48 is provided intermediate its length with at least one nick 49, i.e., at least one break-away connector point (in the figures, three nicks 49 are shown). These break-away connector points 49 cause the cushion flap 47 to be retained in a planar relation with the stop rib 45 until a transverse force (see phantom arrow 50) relative to the plane of that break-away partition panel is exerted on the cushion flap 47. In other words, and as is explained in greater detail below, the cushion flap 47 and stop rib 45 are retained in planar or connected relation as the glued but collapsed carton formed from the carton blank 10 is erected from the collapsed attitude (not shown) into the erected attitude (shown in FIGS. 3–6) because of the connection of the cushion flap with the stop rib at nicks 49 along the cut line 48 which defines the stop rib and the cushion flap at their joinder.

The cushion flap 47 also includes a cut score line 51 from one end edge 52 to the other end edge 53 which is parallel to the adjacent side wall panel's side edge 42 and intermediate the side edges 54, 55 of that cushion flap. The cut score line 51 allows the cushion flap 47 to be divided into two operable cushion panels 47*a*, 47*b* cooperable with a fragile article 70 when the carton 56 is erected and the fragile article inserted, all as more particularly described in detail below. Note further that the cut line 48 with nicks 49 by which the cushion flap 47 is separable from the stop rib 45 is of a generally inverted dome shaped configuration, that configuration being particularly useful in support of the dome end of an electronic tube 70 or the like inserted into the fixed erected carton. Note further that the top edge 52 of the cushion flap 47 is provided with a convex curve type configuratin, which curve structure cooperates with dome end surface of an electronic tube inserted into an erected carton 56 to function as a cam type edge when breaking the cushion flap 47 away from the stop rib 45, also as more particularly described in detail below.

A glue tab 57 is connected along side edge 58 of the break-away partition panel's stop rib 45. This glue tab 57 is connected to that stop rib 45 by a perforated score line 59 that is parallel to the perforated score line 44 by which the stop rib is connected to glue flap 40, that perforated score line 59 thereby also being parallel to the side edge 42 of side wall panel 11. Note particularly this glue tab 57 is connected only to the stop rib 45 itself, it is not connected to the cushion flap 47. Hence, a cushion flap 47 is swingable relative to the stop rib 45, glue flap 40, and glue tab 57 along the hinge line defined by the perforated score line 44 once the nicks 49 between the cushion flap 47 and the stop rib 45 have been broken.

Figure 2:
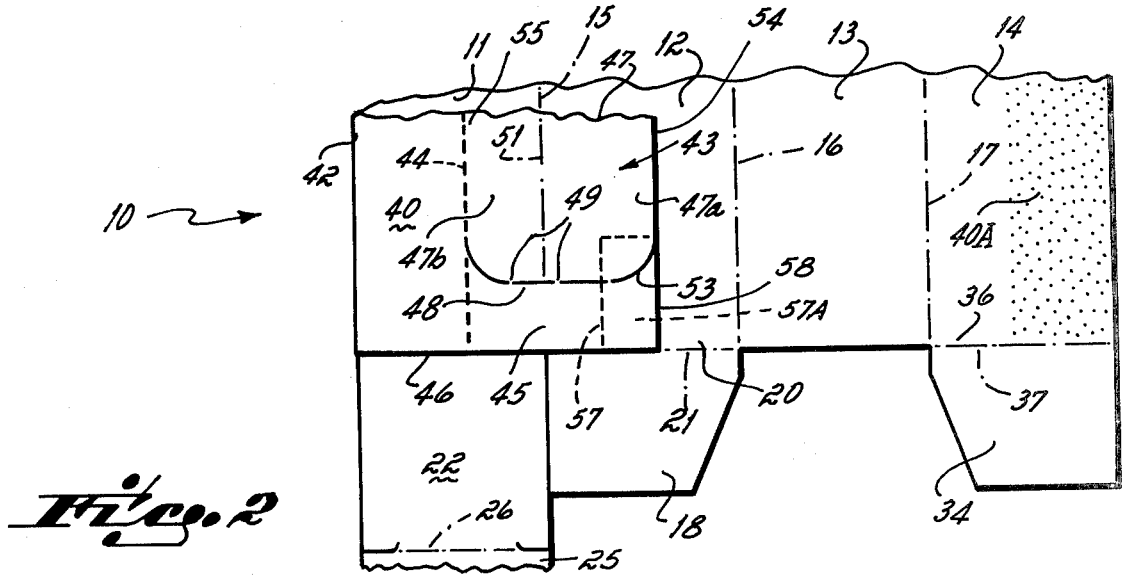
FIG. 2 is a view similar to FIG. 1, but illustrating the carton blank in a partially folded and glued attitude during fabrication of an improved carton from the carton blank.

Gluing of the carton blank 10 illustrated in FIG. 1 into a collapsed carton position (not shown) is partially illustrated in FIG. 2. As shown in FIG. 2, the glue flap 40, break-away partition panel 43 and glue tab 57 are folded over onto the first and second side wall panels 11, 12 at score line 41, 59 and the glue tab 57 is glued in glue area 57A on the second side wall panel. This connects the break-away partition panel 47 with the second side wall panel 12 by means of glue tab 57. With the cartn blank 10 partially glued as shown in FIG. 2, the third 13 and fourth 14 side wall panels are folded on score line 16 over onto the partition panel 43 and glue flap 40. The glue flap 40 is then glued to longitudinal glue area 40A of the fourth side wall panel, thereby attaching the glue flap to the fourth side wall panel. This establishes, in a collapsed or storage position, an improved carton 56 in accord with the principles of this invention. Note that with the carton in the collapsed but fully glued position (not shown) the break-away partition 43 is positively connected to opposed side walls 12, 14 because glue flap 40 is glued to side wall 14, and because glue tab 57 is glued to side wall 12. However, and as referred to above, the cushion flap 47 portion of the break-away partition 43 is connected only to side wall 14 when it is broken away from the stop rib 45 since the glue tab 57 is connected only to the stop rib. Thus, and when the cushion flap 47 is broken away from the break-away partition panel, as described in further detail below in connection with the fully erected carton 56, only the stop rib 45 remains connected between side walls 12 and 14.

The fully erected position of the improved carton in accord with the principles of this invention is particularly illustrated in FIGS. 3–6. As shown in those figures, and when the carton is erected from the flat or collapsed position after it has been fully glued, the side walls 12–14 provide a substantially square cross sectional configuration. Importantly, the breakaway partition 43 is fixed between side walls 12 and 14 in a position that locates it parallel to side walls 11 and 13 and, therefore, transverse to the side walls 12 and 14. This fixed location of the break-away partition 43 is achieved because the partition is connected at one side edge to glue tab 57 which is glued to side wall 12 and is connected at its other side edge to glue flap 40 which is fixed to side wall 14. Note particularly in this erected position that the stop rib 45 portion of the break-away partition 43 is located adjacent the bottom edge 40 of the carton, i.e., adjacent the bottom end wall 22. Also note particularly that the break-away partition 43 is spaced off center relative to center longitudinal plane 60 between the side walls 11, 13 i.e., the distance D from side wall 11 to partition 43 is greater than the distance d' from side wall 13 to partition 43. This combined off center and parallelism location of the break-away partition 43 relative to the opposed side walls 11, 13, i.e., relative to a longitudinal plane 60 evenly located between those side walls, allows the dome 71 of an electronic tube 70 to easily cooperate with the cam edge 52 of the break-away partition's cushion flap 47 as the tube is inserted dome 71 end first into the carton from the top edge 39 thereof.

Figure 3:
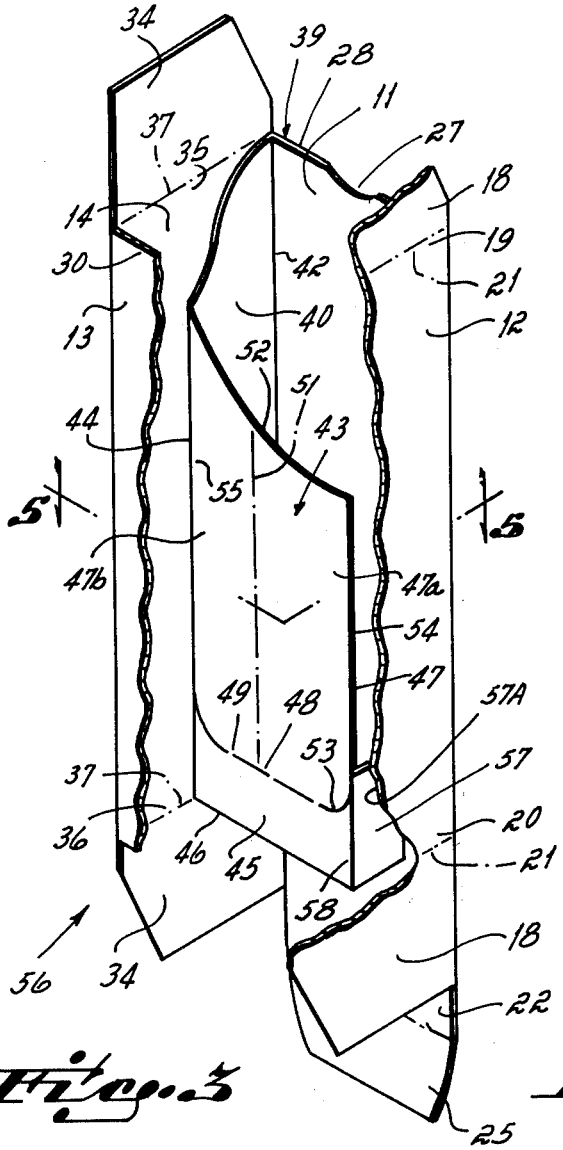
FIG. 3 is a perspective view partly in section, of an erected carton in accord with the principles of this invention, the carton being illustrated prior to introduction of a fragile article into the carton.

With the carton 56 fully erected as shown in Figures 3 and 5, it will be particularly noted that the break-away partition's cushion flap 47 is held in planar relation with the breakaway partition's stop rib 45 by virtue of the nicks 49 that connect these two partition sections. As the electronic tube's dome 71 end is inserted into the open end of the carton 56, that dome end cooperates with the cushion flap's cam edge 52 to cause the cushion flap 47 to break or tear away from its connected relation with the stop rib 45, therby causing that cushion flap to pivot toward the FIG. 4 and 6 position as the electronic tube 70 is inserted into the carton. The longitudinal cut end score line 51 provided in the cushion flap 47 allows the cushion flap to deform into separate panels 47*a*, 47*b* which cooperate with the side walls 72 of the electronic tube as shown in FIG. 6 to maintain spaced relation of that tube from two 11, 14 of the adjacent side walls of the erected carton. The tube 70 itself is properly positioned within the carton in inverted fashion when the tube's dome 71 abuts the transversely positioned and immobile stop rib 45, and when the cushion flap 47 biases the tube into a corner of the carton defined by adjacent sidewalls 12, 13, see FIG. 6. The stop rib 45 is immobile, i.e., is not hinged for motion, because of its being glued to opposed side walls 12, 14. It is believed this cushion flap 47 break-away action causes the cushion flap to provide a little better cushioning action for the electronic tube 70 once that tube is inserted into the carton, and to provide a little better tube stability within the carton, because of the somewhat greater resilience provided by that flap since the hinge line 44 of the cushion flap is not flexed at all until the cushion flap is actually broken away from the stop rib 45 upon initial insertion after the carton has been erected from a collapsed position. Note also that the stop rib 45 itself has no score line intermediate its side edges 44, 58, the stop rib thereby remaining relatively rigid to provide somewhat better support to the electronic tube 70 and to the erected carton 56 at that end where the rib is located after the carton is erected. As to the configuration of the carton 56 when it is erected, the width W′ of each side wall must be greater than the diameter M of the elongated fragile article 70 accommodated within the carton, but the diameter M of that article cannot be less than the minor distance D′ between the stop rib 45 and the parallel side walls 11, 13 in order to obtain the functional objectives of this carton structure. The breakaway cushion flap 47 also permits a standard size carton to be used with different diameter elongated fragile articles, e.g., different diameter electronic tubes 70. The different size tube packaging advantage of this carton 56 structure eliminates a carton inventory problem for the manufacturer, and permits the same carton packaging machine to fill the standard sized carton with different sized tubes.

Having described in detail the preferred embodiment of my invention, what I desire to claim and protect by Letters Patent is:

1. An improved carton for use in packaging an elongated fragile article, said carton comprising multiple sidewalls connected one to the other, a stop rib fixed to two opposed sidewalls at opposite ends of said stop rib, said stop rib being located at one end of said carton, and said stop rib being adapted to receive one end of said article in seated relation thereagainst for retaining said article in spaced relation from the one end of said carton, a cushion flap hingedly connected at one side edge to one of those sidewalls to which said stop rib is fixed and unconnected at the other side edge to the other of those sidewalls to which said stop rib is fixed, and at least one breakaway nick connecting said stop rib and said cushion flap in planar relation when said carton is erected prior to insertion of said article therein, said cushion flap being broken away from connected relation with said stop rib as said article is inserted into the open end of the erected but unfilled carton, said cushion flap being swingable on a hinge line to accommodate insertion of said article in said carton, and said broken away cushion flap cooperating with said article to bias said article against at least two sidewalls of said carton for retaining said article in spaced relation from at least one other sidewall of said carton.

2. An improved carton as set forth in claim 1, said stop rib being positioned generally parallel to opposed sidewalls, and said stop rib being spaced from one of said opposed sidewalls a lesser distance than the distance said stop rib is spaced from the other of said opposed sidewalls.

3. An improved carton as set forth in claim 2, the unconnected side edge of said cushion flap contacting one of the sidewalls of said carton to which said stop rib is not attached as said article is inserted into said carton for aid in restricting the swinging motion of said cushion flap.

4. An improved carton as set forth in claim 3, said nick being in a cut line that partially defines said cushion flap and said stop rib and that is oriented generally transversed to the longitudinal axis of said carton.

5. An improved carton as set forth in claim 3, said cushion flap having at least two panels separated by a score line oriented parallel to the longitudinal axis of said carton, said score line permitting said panels to flex relative one to the other and, thereby, to cushion said article about the periphery thereof through use of both panels when said article is packaged in said carton.

6. An improved carton as set forth in claim 3, said cushion flap incorporating a cam edge as a top edge thereof, said cam edge cooperating with said article upon insertion of said article to break said cushion flap away from said stop rib.

7. A carton blank particularly adapted for use in erecting a carton for packaging an elongated fragile article, said blank comprising multiple sidewalls hingedly connected one to the other, a stop rib hingedly connected to one of said sidewalls, said stop rib being fixed to two opposed sidewalls at opposite ends of said stop rib when said carton is erected, said stop rib being located adjacent one end edge of said carton blank, and said stop rib being adapted to receive one end of said article in seated relation thereagainst for retaining said article in spaced relation from one end of a carton erected from said carton blank, a cushion flap hingedly connected at one edge to the same sidewall to which said stop rib is fixed, said cushion flap being unconnected at the other side edge to the other of those sidewalls to which said stop rib is fixed in a carbon erected from said carton blank, and at least one breakaway nick connecting said stop rib and said cushion flap in planar relation, said breakaway nick retaining said stop rib and said cushion flap in planar relation when a carton is erected from said carton blank prior to insertion of said article therein, said cushion flap being broken away from connected relation with said stop rib as said article is inserted into the open end of the erected but unfilled carton, said cushion flap being swingable on a hinge line to accommodate insertion of said article in said erected carton, and said broken away cushion flap cooperating with said article to bias said article against at least two sidewalls of said erected carton for retaining said article in spaced relation from at least one other sidewall of said erected carton.

8. A carton blank as set forth in claim 7, said cushion flap being sized so that the unconnected side edge of said cushion flap will contact one of the sidewalls of the erected carton to which said stop rib is not attached as said article is inserted into said erected carton for aid in restricting the swinging motion of said cushion flap.

9. A carton blank as set forth in claim 8, said nick being in a cut line that partially defines said cushion flap and said stop rib and that is oriented generally transverse to the side edges of said sidewalls.

10. A carton blank as set forth in claim 8, said cushion flap having at least two panels separated by a score line oriented parallel to the side edges of said sidewalls, said score line permitting said panels to flex relative one to the other and, thereby, to cushion an article about the periphery thereof through use of both panels when said article is packaged in a carton erected from said blank.

11. A carton blank as set forth in claim 10, said stop rib being positioned in said blank so that said rib is generally parallel to opposed sidewalls when a carton is erected therefrom, and said stop rib being positioned in said blank so that said rib is spaced from one of said opposed sidewalls a lesser distance than the distance said stop rib is spaced from the other of said opposed sidewalls when said carton is erected.

12. A carton blank as set forth in claim 11, said cushion flap incorporating a cam edge at a top edge thereof, said cam edge cooperating with an article upon insertion of said article in a carton formed from said blank to break said cushion flap away from said stop rib upon filling of said carton.

* * * * *